US006634870B2

(12) United States Patent
Dreiman et al.

(10) Patent No.: US 6,634,870 B2
(45) Date of Patent: Oct. 21, 2003

(54) HERMETIC COMPRESSOR HAVING IMPROVED MOTOR COOLING

(75) Inventors: Nelik I. Dreiman, Tipton, MI (US); Rick L. Bunch, Tecumseh, MI (US)

(73) Assignee: Tecumseh Products Company, Tecumseh, MI (US)

( * ) Notice: Subject to any disclaimer, the term of this patent is extended or adjusted under 35 U.S.C. 154(b) by 0 days.

(21) Appl. No.: 10/029,850

(22) Filed: Jan. 3, 2002

(65) Prior Publication Data

US 2003/0124004 A1 Jul. 3, 2003

(51) Int. Cl.[7] ..... F04B 17/00

(52) U.S. Cl. ..... 417/368; 417/357; 417/366; 417/369; 417/419; 417/902

(58) Field of Search ..... 417/357, 366, 417/368, 369, 419, 902

(56) References Cited

U.S. PATENT DOCUMENTS

| | | | | | |
|---|---|---|---|---|---|
| 2,839,898 | A | | 6/1958 | Green | 62/2 |
| 3,133,429 | A | * | 5/1964 | Griffin | 417/313 |
| 3,238,400 | A | | 3/1966 | Wireman | 310/54 |
| 3,790,309 | A | | 2/1974 | Volz | 417/368 |
| 3,922,114 | A | * | 11/1975 | Hamilton et al. | 417/366 |
| 4,059,777 | A | | 11/1977 | Whitely | 310/64 |
| 4,312,627 | A | * | 1/1982 | Jacobs et al. | 417/363 |
| 4,396,361 | A | * | 8/1983 | Fraser, Jr. | 417/368 |
| 4,477,233 | A | | 10/1984 | Schaefer | 417/366 |
| 4,552,518 | A | * | 11/1985 | Utter | 418/55.6 |
| 4,573,324 | A | | 3/1986 | Tischer et al. | 62/115 |
| 4,741,177 | A | | 5/1988 | Glanvall | 62/470 |
| 4,850,816 | A | | 7/1989 | Kosfeld | 417/313 |
| 4,995,791 | A | | 2/1991 | Loprete | 417/366 |
| 5,322,420 | A | * | 6/1994 | Yannascoli | 417/366 |
| 5,350,039 | A | | 9/1994 | Voss et al. | 184/6.16 |
| 5,464,332 | A | | 11/1995 | Beck et al. | 417/368 |
| 5,623,829 | A | | 4/1997 | Nutter et al. | 62/5 |
| 5,687,766 | A | | 11/1997 | Weakley | 137/812 |
| 6,131,406 | A | | 10/2000 | Barowsky et al. | 62/505 |

* cited by examiner

*Primary Examiner*—Cheryl J. Tyler
*Assistant Examiner*—Timothy P. Solak
(74) *Attorney, Agent, or Firm*—Baker & Daniels

(57) ABSTRACT

A hermetic refrigerant compressor including a compressor mechanism and a motor including a stator surrounded by a rotor attached to a crankshaft drivingly linked to the compressor mechanism. A first gap is formed between the rotor and stator, and a second gap is formed between the stator and the compressor mechanism. During compressor operation discharge gas expelled from the gas compression chamber travels through a discharge passage and a discharge plenum, and then through the first and second gaps. The rotor spinning during compressor operation causing a spinning vortex of refrigerant gas to occur in the discharge plenum, the vortex having an outer flow path of warmer gas and an inner flow path of cooler gas. The outer flow path of warmer gas generally travels through the second gap and the inner flow path of cooler gas generally travels through the first gap for enhanced motor cooling.

11 Claims, 5 Drawing Sheets

HERMETIC COMPRESSOR HAVING IMPROVED MOTOR COOLING

BACKGROUND OF THE INVENTION

The present invention relates generally to a hermetic compressor assembly and, more particularly, to a direct suction compressor assembly having a crankcase mounted within a hermetically sealed housing. Suction gas is delivered directly to the crankcase, or a cylinder head attached to the crankcase, from a refrigerant system suction line outside the housing by means of a suction inlet connector or adaptor. In general, prior art hermetic compressor assemblies comprise a hermetically sealed housing having a compressor mechanism mounted therein. The compressor mechanism includes a crankcase or cylinder block having a cylinder/compression chamber formed therein for compressing and discharging gaseous refrigerant.

In a high side reciprocating compressor, which is characterized by a pressurized housing, suction gas received from a refrigeration system is introduced directly into the compression chamber, or at least a suction cavity adjacent the compression chamber. This is generally accomplished by means of a conduit extending from outside the housing to the compression chamber within the crankcase. This configuration is commonly referred to as a direct suction compressor assembly. In direct suction compressor assemblies, a suction inlet conduit is introduced through the hermetically sealed housing, through a discharge chamber formed in the housing, and into a suction inlet bore formed in the crankcase/cylinder block or cylinder head. The suction inlet bore is directly or indirectly, such as through a suction cavity formed in the cylinder head, in communication with the compression chamber. That portion of the tubing external to the housing may comprise part of a suction accumulator or may constitute a fitting to which a suction line of a refrigeration system is attached.

One problem associated with assembly of direct suction type compressors concerns misalignment of the suction inlet bore of the crankcase with respect to the suction inlet opening and inlet fitting in the housing sidewall and the suction conduit therebetween. Misalignment can lead to excessive stress and material degradation with respect to the suction conduit and related coupling devices. Manufacturing tolerances for component parts of the direct suction compressor assembly, i.e., parts having apertures and openings through which the suction conduit extends, may complicate compressor assembly and result in undesirable stress on the suction conduit once the compressor is assembled.

A second problem associated with the above-characterized direct suction compressor assembly occurs during compressor operation and relates to the transmission of vibration and noise from the compressor assembly to the housing by means of the suction conduit and associated linkages therebetween. Specifically, the compressor mechanism may undergo slight excursions in response to axial, radial, and torsional forces acting thereupon during compressor operation. Consequently, the nature of the linkage between the compressor mechanism and the stationary housing determines the extent to which vibration and noise are imparted to the housing.

The suction inlet connector must also withstand such forces and maintain seal integrity to prevent leakage from the interior of the housing. One common prior art approach to compensating for radial spacing and movement between the housing and the crankcase suction inlet opening is the provision of an O-ring seal within the suction inlet bore and/or the suction inlet fitting to allow the suction conduit to variably penetrate into the bore. Typically, this approach utilizes a fitting at the housing opening which is welded to the housing and brazed to the conduit. A primary problem of this arrangement is that it provides for only one degree of freedom for movement of the compressor during operation, radial movement.

Another prior art approach to compensating for misalignment involves a suction tube connector directed to compensating for spacing variations between the housing and the compressor crankcase. A tube is disposed radially inwardly from the housing sidewall and is provided with a slotted conical flange at one end to abut against the crankcase in the general area of the suction inlet bore. The divergent end of the conical flange has a diameter greater than the suction inlet bore, thereby permitting alignment variations.

With respect to suction line connectors for use in indirect suction hermetically sealed compressor assemblies, i.e., low side compressors where the suction gas enters into the interior space of the housing, a suction line adapter device is known which is attached to the housing as by welding. This adapter comprises two pieces, one of which is welded to the housing at the location of the opening therethrough and the other being a coupling member attachable to a refrigeration system suction line as by brazing or the like. The coupling member with suction line attached thereto is then screwed onto the fitting welded to the housing for sealing engagement therewith. A nut threadably engages each of the two components and brings them forcibly together at a surface to surface juncture having an O-ring seal seated there between.

Further, a suction line adaptor is known which comprises a pair of L-fittings respectively attached to the housing and the crankcase at axially spaced locations thereon, and a connecting pipe inside the housing between the pair of L-fittings axially perpendicular to and disposed between the housing and the crankcase. The connecting pipe is capable of moving relative to one or both of the L-fittings to compensate for variations in radial and axial spacing between the housing and the crankcase. A problem with such a suction tube adapter is that space is required between the crankcase and the housing sidewall within the housing. Also, this type of adaptor complicates assembly and is not suitable for high side compressor applications.

Prior suction inlet adapters and couplings for use in direct suction type hermetic compressors are disclosed in U.S. Pat. No. 4,844,705 (Ganaway) and U.S. Pat. No. 4,969,804 (Ganaway), which are hereby incorporated into this document by reference and which are assigned to the assignee of the present invention. U.S. Pat. No. 4,844,705 discloses a suction line adapter which includes a tubular insert disposed between the suction inlet bore of the crankcase and the suction inlet opening formed in the housing sidewall. The tubular insert is sealed with respect to the suction inlet bore of the crankcase by use of an O-ring. The tubular insert is sealed with respect to the suction inlet opening of the housing by use of an outwardly extending flange disposed between three component parts of a suction inlet adapter coupling. U.S. Pat. No. 4,969,804 discloses a tubular insert which is sealed at one end to the suction inlet bore of the crankcase by use of an O-ring. The tubular insert is sealed at the opposite end with respect to the suction inlet opening in the housing by use of an O-ring and a three-piece suction adapter coupling.

Typically during compressor operation, discharge gas is discharged from the compression chamber directly into the discharge chamber within the housing and surrounding the motor and compressor mechanism. Because the discharge gas is at a higher temperature relative to the suction gas temperature and because the motor operating efficiency decreases as the motor temperature increases due to heat absorbed from the surrounding discharge gas, the overall compressor efficiency is adversely affected.

The vortex tube effect, known also as the Ranque Vortex Tube effect, the Hilsch Tube effect, the Ranque-Hilsch Tube effect, the Coanda effect, and Maxwell's Demon, was discovered in 1928 by George Ranque, and involves providing a dual output flow arrangement consisting of a warmer fluid flow path and a cooler fluid flow path from a single or combined fluid source. The vortex tube effect is accomplished in one respect by introducing a compressed fluid source into a vortex tube which is adapted to impart a spinning motion on the fluid flowing therethrough. The vortex tube effects the formation of an outer flow path, which flows in one direction, and an inner flow path, which flows in an opposite direction. This effect is characterized in that the inner flow path gives off kinetic energy in the form of heat to the outer flow path, whereby an output of cooler fluid occurs at one end of the vortex tube and an output of warmer fluid occurs at an opposite end of the vortex tube.

SUMMARY OF THE INVENTION

The present invention involves establishing bidirectional flow paths of discharge gas in a discharge plenum for cooling the motor during compressor operation. The present invention provides a discharge gas passage and surrounding the lower portions of the stator and rotor and in communication with a gas compression chamber within the compressor mechanism. During compressor operation, discharge gas is forcibly expelled from the gas compression chamber through a discharge passage, and into the discharge plenum.

According to the present invention, the spinning motion of the rotor imparts a spinning vortex effect on the discharge gas collected in the discharge plenum. The vortex effect causes an inner flow path and an outer flow path to form. The inner flow path flows in a direction opposite the outer flow path and gives off kinetic energy in the form of heat to the outer flow path. A first gap is provided between the rotor and the stator and a second gap is provided between the casing and the stator. The cooler or reduced temperature fluid in the inner flow path flows from the discharge plenum through the first gap and is discharged into the discharge chamber formed in the compressor housing. The warmer or elevated temperature discharge gas in the outer flow path travels through the second gap and is discharged into the discharge gas chamber. By circulating cooler fluid between the rotor and the stator, the motor is effectively cooled, resulting in enhanced motor operating efficiency and increased overall compressor operating efficiency. This is in dramatic contrast to direct suction hermetic compressors of the prior art in which discharge gas is discharged generally directly into the discharge chamber of the housing after compression.

Yet another advantage of the present invention is that discharge gas collected in the discharge plenum is subjected to the vortex tube effect during compressor operation, thereby effecting a continuous flow of cooler fluid through a gap formed between the rotor and the stator. The flow of cooler fluid effectively cools the motor during compressor operation and increases motor operating efficiency and overall compressor operating efficiency.

In another embodiment, the present invention provides a reciprocating hermetic refrigerant compressor having a hermetically sealed housing, a compressor mechanism, and a motor. The housing provides a sidewall having a suction inlet opening. The compressor mechanism is disposed in the housing and has a suction inlet bore, a gas compression chamber and a discharge passage formed therein, the discharge passage in communication with a discharge plenum.

The motor includes a stator attached to a crankcase, and a rotor attached to a crankshaft drivingly connected to the compressor mechanism and surrounded by the stator. A first gap is formed between the rotor and the stator and a second gap is formed between the stator and the crankcase. During compressor operation discharge gas travels through the discharge cavity, through the discharge passage, and through the first and second gaps. The rotor spins during compressor operation resulting in the Ranque vortex tube or Coanda effect, which accomplishes enhanced cooling of the motor.

In a further embodiment, the present invention provides a method of cooling a motor in a hermetic refrigerant compressor. The compressor includes a compressor mechanism having a gas compression chamber therein, such as a crankcase with a cylinder, and a motor having a stator and rotor. The method comprises the following steps. Gas is discharged from the gas compression space during compressor operation into a discharge gas plenum provided in the compressor crankcase. A spinning vortex of discharge gas is generated within the discharge plenum, whereby an inner flow path of cooler gas and an outer flow path of warmer gas are formed. A first gap between the stator and rotor and a second gap between the stator and crankcase are formed in the compressor. The cooler gas in the inner flow path travels through the first gap and the warmer gas in the outer flow path travels through the second gap.

Accordingly, the present invention provides a hermetic refrigerant compressor including a hermetically sealed housing having a wall with a suction opening, a compressor mechanism disposed in the housing and having a gas compression chamber therein and a discharge passage in communication with a discharge plenum, and a motor including a stator and a rotor attached to a crankshaft drivingly linked to the compressor mechanism. The rotor is surrounded by the stator and a first gap is formed between the rotor and stator. A second gap is formed between the stator and the compressor mechanism. During compressor operation discharge gas expelled from the gas compression chamber travels through the discharge passage, through the discharge plenum, and then through the first and second gaps. The rotor spinning during compressor operation causing a spinning vortex of refrigerant gas to occur in the discharge plenum, the vortex having an outer flow path of warmer gas and an inner flow path of cooler gas. The outer flow path of warmer gas generally travels through the second gap and the inner flow path of cooler gas generally travels through the first gap for enhanced motor cooling.

The present invention also provides a hermetic refrigerant compressor including a hermetically sealed housing having a wall with a suction opening, a compressor mechanism disposed in the housing and having a gas compression chamber therein and a discharge passage in communication with a discharge plenum, and a motor including a stator and a rotor attached to a crankshaft drivingly linked to the compressor mechanism. The rotor is surrounded by the stator, and a first gap is formed between the rotor and the stator. A second gap is formed between the stator and the compressor mechanism. During compressor operation discharge gas expelled from the gas compression chamber travels through the discharge passage, through the discharge plenum, and then through the first and second gaps. The rotor spinning during compressor operation forms a first flow path of warmer gas and a second flow path of cooler gas. The first flow path of warmer gas generally travels through the second gap and the second flow path of cooler gas generally travels through the first gap for enhanced motor cooling.

The present invention further provides a method of cooling the motor in a hermetic refrigerant compressor including a compressor mechanism having a gas compression chamber therein, and a motor having a stator and a rotor. The inventive methods includes communicating gas discharged from the gas compression chamber during compressor operation into a discharge gas plenum provided between the compressor mechanism and the motor; creating a spinning vortex of discharge gas within the discharge plenum, whereby an inner flow path of cooler gas and an outer flow path of warmer gas are formed; and providing a first gap between the stator and rotor and a second gap between the stator and compressor mechanism and causing the cooler gas in the inner flow path to flow through the first gap and the warmer gas in the outer flow path to flow through the second gap.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

DETAILED DESCRIPTION OF THE INVENTION

Figure 1:
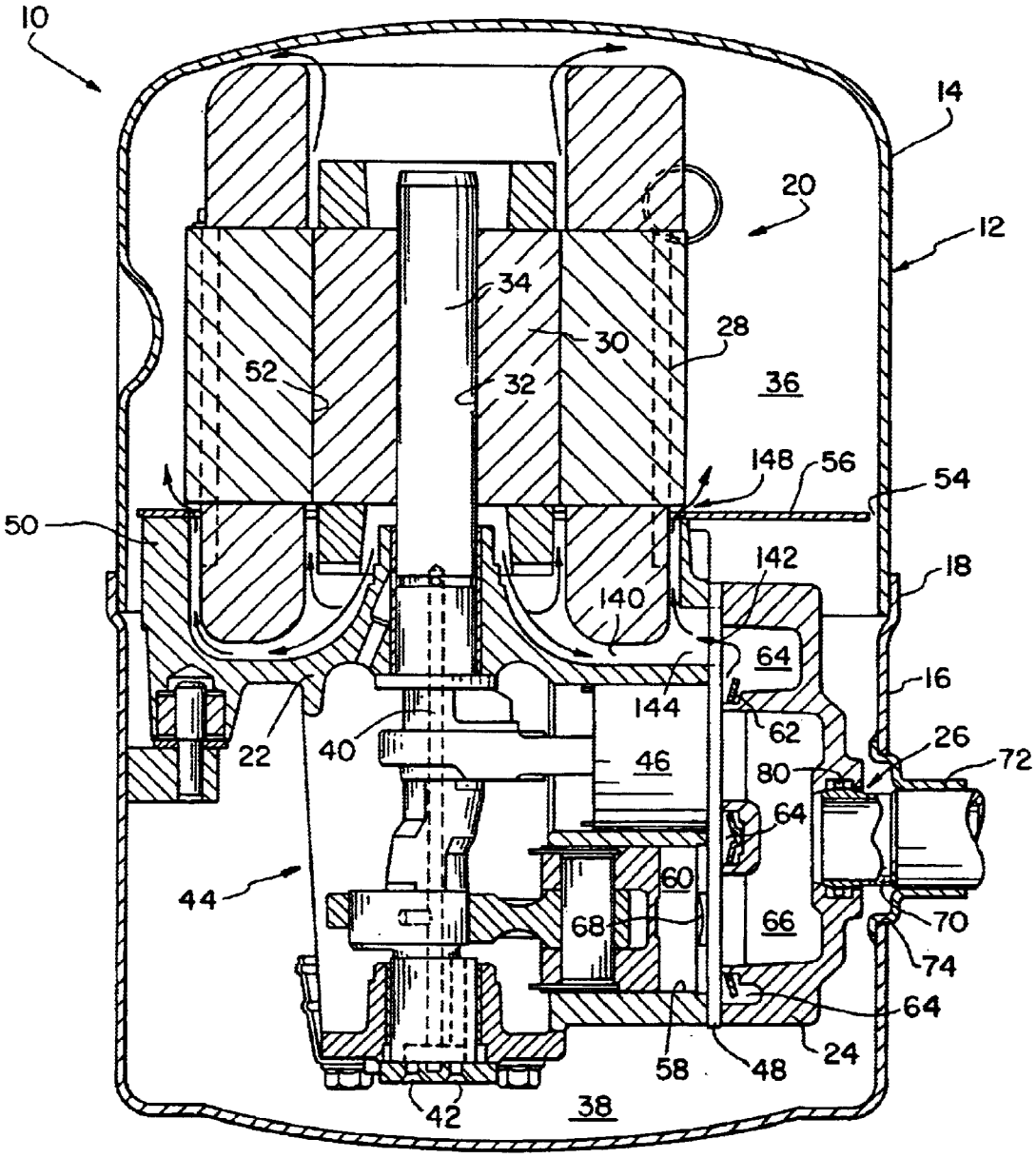
FIG. 1 is a side-sectional view of the direct suction hermetic refrigerant compressor of the present invention.

In an exemplary embodiment of the invention as shown in the drawings, and in particular by referring to FIG. 1, compressor assembly 10 is a direct suction hermetically sealed reciprocating refrigerant compressor having a housing generally designated at 12. The housing has a top portion 14 and a bottom portion 16. The two housing portions are hermetically secured together as by welding or brazing shown generally at interface joint 18. Located within hermetically sealed housing 12 is electric motor 20, crankcase 22, cylinder head 24, and suction inlet connector assembly 26. Electric motor 20 includes stator 28 and rotor 30 which has central aperture 32 provided therein into which is secured crankshaft 34 by an interference fit. Motor 20 is connected to a source of electric power through a terminal cluster (not shown) and is a three phase motor, whereby bi-directional operation of compressor assembly 10 is achieved by changing the connection of power at the terminal cluster. Also in housing 12 is discharge chamber 36 and oil sump 38. During compressor operation, oil is drawn into axial lubricating oil passageway 40, provided as a center bore in crankshaft 34, via oil intakes 42 from sump 38. Radial oil passages extending radially from axial lubricating oil passageway 40 through crankshaft 34 delivers lubricating oil to various moving parts of the compressor mechanism designated generally as 44.

Compressor mechanism 44 comprises crankcase 22, pistons 46, valve plate 48, and cylinder head 24. Crankcase 22 includes a plurality of mounting lugs 50 to which motor stator 28 is attached such that there is an annular air gap or channel 52 between stator 28 and rotor 30. Annular space 54, intermediate the peripheral edge of separating plate 56 and housing top portion 14, provides communication between the top and bottom ends of housing 12 for equalization of discharge pressure within the entire housing interior.

Compressor mechanism 44 takes the form of a reciprocating piston type compressor in the disclosed embodiment, wherein crankcase 22 is generally made of cast iron or aluminum and includes two radially disposed cylinders 58. Pistons 46, cylinders 58, and valve plate 48 define compression chamber 60. During compressor operation and specifically during the compression stroke, refrigerant gases are compressed in compression chamber 60 and discharged via discharge valve 62 through valve plate 48 and into discharge cavity 64 formed in cylinder head 24. Cylinder head 24 is preferably made of cast iron or aluminum.

During the suction stroke, suction gas is drawn into suction cavity 66 formed in cylinder head 24 from a refrigerant system suction line 124 via suction inlet connector assembly 26. Suction gas enters compression chamber 60 from suction cavity 66 via suction valve 68 provided on suction valve plate 48. In the alternative, a suction plenum may be formed in the crankcase surrounding cylinders 46, whereby suction gas may be drawn directly into crankcase 22 and into cylinders 46 via apertures formed in the cylinder walls.

Suction inlet connector assembly 26, as shown throughout the figures in various embodiments, comprises suction inlet conduit 70 which is preferably made of steel, but can be molded from plastic such as Valox, Nylon, etc., and is received by suction inlet fitting 72. Suction inlet fitting 72 extends radially outwardly from lower housing portion 16 at suction inlet opening 74. A first end 76 of suction inlet conduit 70 is received by suction inlet bore 78 provided in cylinder head 24 adjacent suction inlet opening 74. The space within housing 12 between suction inlet fitting 72 and suction inlet bore 78 is at discharge pressure, whereas suction cavity 66 of cylinder head 24 is at suction pressure.

Suction inlet seal 80 is disposed intermediate suction inlet conduit 70 and suction inlet bore 78. Suction inlet seal 80 seals suction conduit 70 relative to cylinder head 24 at suction inlet bore 78 so as to prevent leakage of discharge gas within housing 12 into suction cavity 66. In the embodiment shown in FIG. 1, suction inlet fitting 72 is preferably made of steel, but can be molded from plastic such as Valox, Nylon, etc., and is sealingly secured, such as by welding or by brazing, to lower housing portion 16 and suction inlet conduit 70 so as to prevent the escape of discharge gas from within housing 12 to the area surrounding compressor assembly 10.

Manufacturing tolerances inherent in compressor assembly 10 may result in misalignment of suction inlet bore 78 relative to suction inlet opening 74 of housing 12. Further, during compressor operation, compressor mechanism 44 moves in response to radial, axial, and torsional forces, resulting in greater misalignment. Prior art suction inlet connectors are subject to material stress which may become excessive depending upon the degree of misalignment. Moreover, such misalignment may cause prior art suction inlet connectors to become unsealed relative to the suction inlet bore, thereby resulting in the leakage of discharge gas into the suction cavity.

According to the improved suction connector of the present invention as shown in FIGS. 1, 2A–2C, and 3A–3B, first end 76 is provided with spherical-shaped protuberance 92. In the context of the present invention, it will be understood that the term "spherical" is not narrowly defined to include only those shapes having a constant radius. Rather, the term "spherical" is intended to apply to any surface that is wholly or partially arcuate or convex, including but not limited to elliptic, parabolic, and hyperbolic surfaces. Suction inlet seal 80 is disposed in annular seal recess or gland 90 formed in cylinder head 24 at suction inlet bore 78. In the alternative suction inlet conduits shown in FIGS. 4B, 4C, 4E, and 4F, seal receiving recesses 90 may be provided at either or both ends of suction inlet conduit 70.

The spherical protuberance 92 at first end 76 of suction inlet conduit 70, in conjunction with mating spherical surface 94 of suction inlet bore 78, allows suction inlet conduit 70 to pivot relative to cylinder head 24 and suction inlet opening 74 so as to compensate for misalignment resulting from manufacturing tolerances or from compressor operation. Seal 80 provides a positive, fluid-tight seal between cup seal rings 82 and first end 76 so as to maintain seal integrity over a wide range of misalignment conditions. Spherical-shaped first end 76 permits compressor mechanism 44 to move in a virtually infinite number of multi-angled directions and compensates for angular misalignments up to four degrees.

Figure 2A:
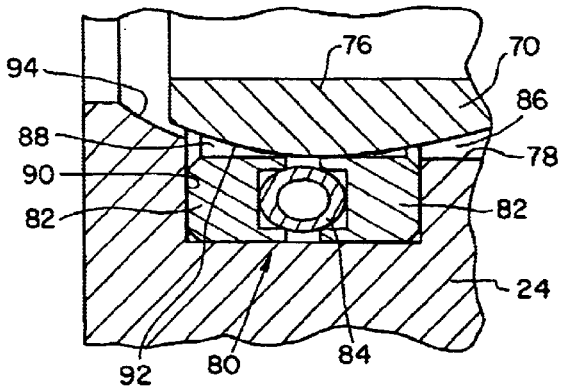
FIG. 2A is a sectional cutaway view showing a first embodiment of the spring-energized seal used with the suction inlet connector of the present invention.
Figure 2B:
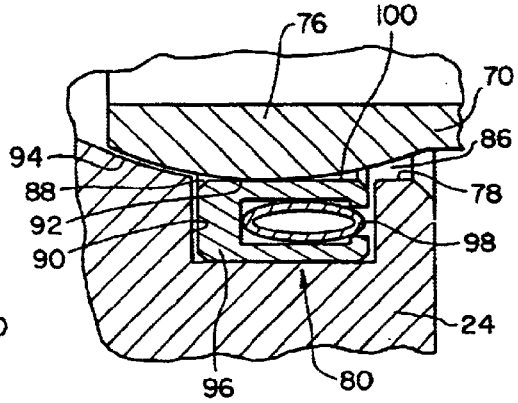
FIG. 2B is a sectional cutaway view of a second embodiment of the spring-energized seal utilized in the suction inlet connector of the present invention.
Figure 2C:
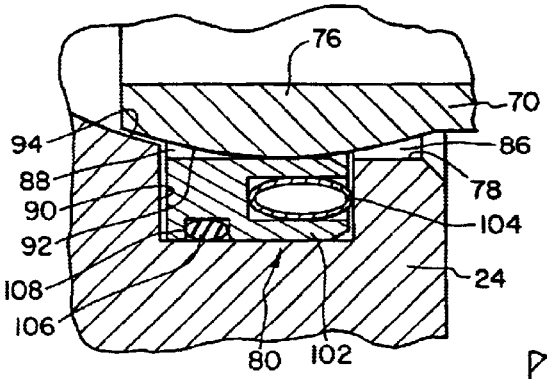
FIG. 2C is a sectional cutaway view of a third embodiment of the spring-energized seal for use with the suction inlet connector of the present invention.

Suction inlet seal 80 is provided in the form of a spring-energized seal assembly which provides a near constant spring force allowing seal 80 to compensate for changes due to initial deflection, wear, temperature changes, and/or tolerance variations. FIGS. 2A through 2C illustrate three alternative embodiments of the spring-energized seal assembly 80 which may be used to seal suction inlet conduit 70 with respect to suction inlet bore 78.

The suction inlet seal 80 illustrated in FIG. 2A includes opposedly facing U-cup annular rings 82 which are preferably made of teflon and are loaded by a single canted-coil spring 84. Canted-coil spring 84 is disposed intermediate opposing seal rings 82 and is preferably made of spring steel or stainless steel. This bi-directional, cylinder head mounted seal functions as a double seal, whereby quick response to rapid pressure changes experienced in either discharge gas pocket 86 or suction gas pocket 88 is achieved. Spring 84 is a high deflection type spring which maintains seal integrity even at zero pressure differential.

FIG. 2B illustrates suction inlet seal 80 comprising C-shaped annular seal ring 96 in combination with canted-coil spring 98. As described above, a near constant spring force is exerted at upper surface 100, which maintains constant contact with semi-spherical protuberance 92 of suction inlet conduit first end 76 throughout a wide range of misalignment conditions.

FIG. 2C illustrates a third embodiment of suction inlet seal 80, wherein generally C-shaped seal ring 102 is acted upon by canted-coil spring 104 so as to maintain contact with protuberance 92 of first end 76. In this manner, seal 80 maintains seal integrity and prevents leakage of discharge gas from discharge pocket 86 into suction gas pocket 88. In addition, O-ring seal 106 is disposed in recess 108 of seal ring 102 enhance seal integrity.

Figure 3A:
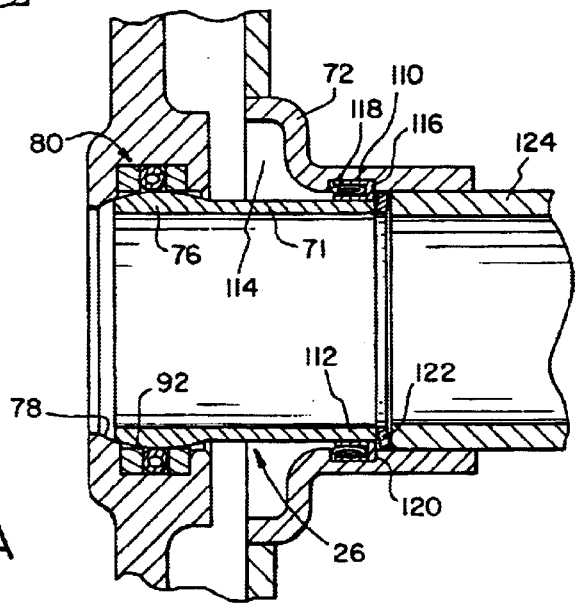
FIG. 3A is a sectional cutaway view of a first embodiment of the suction inlet connector assembly of the present invention.
Figure 3B:
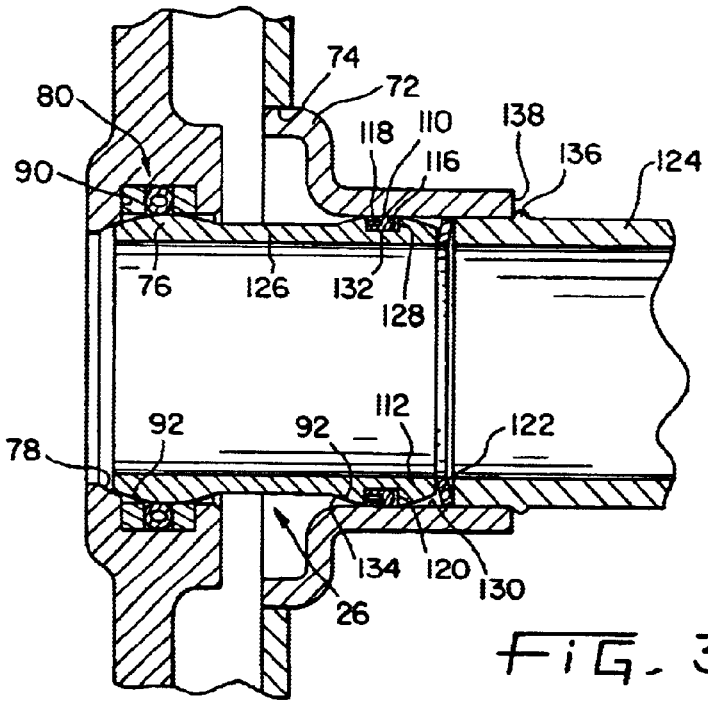
FIG. 3B is a cross-sectional cutaway view of a second embodiment of the suction inlet connector assembly of the present invention.
Figure 4A:
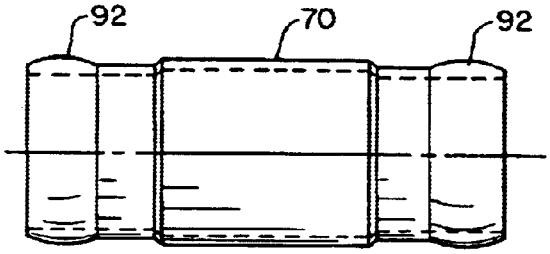
FIG. 4A is a side view of a first embodiment of the suction inlet conduit associated with the suction inlet connector of the present invention.
Figure 4B:
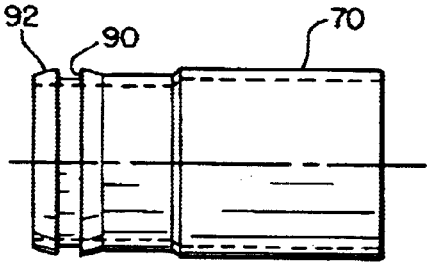
FIG. 4B is a side view of a second embodiment of the suction inlet conduit utilized in the suction inlet connector assembly of the present invention.
Figure 4C:
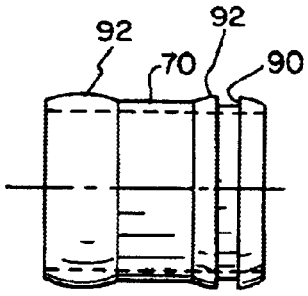
FIG. 4C is a side view of a third embodiment of the suction inlet conduit associated with the suction inlet connector assembly of the present invention.
Figure 4D:
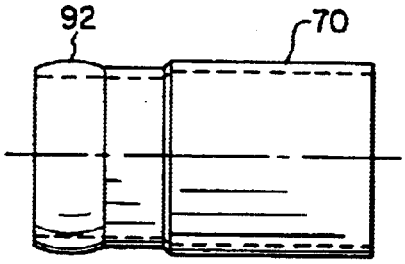
FIG. 4D is a side view of a fourth embodiment of the suction inlet conduit associated with the suction inlet connector assembly of the present invention.
Figure 4E:
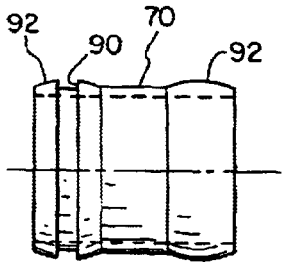
FIG. 4E is a side view of a fifth embodiment of the suction inlet conduit associated with the suction inlet connector assembly of the present invention.
Figure 4F:
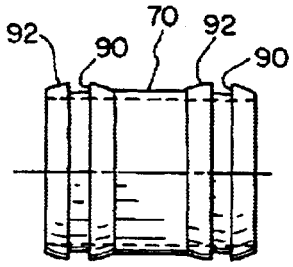
FIG. 4F is a side view of a sixth embodiment of the suction inlet conduit associated with the suction inlet connector assembly of the present invention.

According to the present invention as illustrated in FIGS. 3A and 3B, a second spring-energized seal 110 may be provided intermediate suction inlet conduit 71 and suction inlet fitting 72. Second seal 110 affords greater compensation for misalignment and enables suction inlet connector assembly 26 to maintain seal integrity over an even wider range of misalignment. Protuberance 92 at first end 76 operates in conjunction with suction inlet seal 80 at suction inlet bore 78 as described above. Second end 112 of suction inlet conduit 71 is surrounded by and engages with annular seal 110 so as to prevent leakage of discharge gas from discharge gas pocket 114 into suction inlet conduit 71 or to the area surrounding compressor assembly 10. Spring-energized seal 110 comprises C-shaped seal ring 116 and canted-coil spring 118 and is received in recess or gland 120 formed in suction inlet fitting 72. Disc spring 122 is disposed intermediate suction inlet conduit 71 and refrigerant system suction line 124, which is typically secured to suction inlet fitting 72 by brazing or welding.

FIG. 3B illustrates alternative suction inlet conduit 126 having spherical protuberances 92 at both first end 76 and second end 112. First suction inlet seal 80 is disposed in recess 90 formed in suction inlet bore 78. Second seal 110, comprising C-shaped seal ring 116 and canted-coil type spring 118, is disposed in annular recess 128 formed in protuberance 92 at second end 112. Seal 110 via seal ring 116 maintains contact with inner surface 130 of suction inlet fitting 72 and inner recess surface 132 to maintain a sealed relationship between suction inlet conduit 126 and suction inlet fitting 72 throughout a wide range of misalignment conditions.

Spherical surface 134 of protuberance 92 at second end 112 allows suction inlet conduit 126 to pivot with respect to suction inlet fitting 72. This pivoting motion compensates for misalignment conditions between compressor mechanism 44 and housing 12, particularly between suction inlet bore 78 and suction inlet opening 74, respectively. Disc spring 122 is disposed intermediate suction inlet conduit 126 and refrigerant system suction line 124 to maintain a sealed relationship therebetween. Protuberance 136 extends from the outer surface of refrigerant system suction line 124 and abuts surface 138 of suction inlet fitting 72 so as to limit the introduction of suction line 124 into suction inlet fitting 72. A screen-filter (not shown) may be provided between end 112 and incoming suction inlet line 124.

FIGS. 4A through 4F illustrate six alternative embodiments of the suction inlet conduit utilized in the improved suction inlet connector assembly in accordance with the present invention. These alternative conduits utilize protuberances 92 and seal ring recesses 90 in various combinations and arrangements. These arrangements are not exhaustive and are merely provided as examples of the types of conduits which may be used to effect the enhanced misalignment compensation function of the present invention.

Another aspect of the present invention involves establishing bidirectional flow paths of discharge gas in discharge plenum 140 formed in crankcase 22. During compressor operation, discharge gas is expelled from compression chamber 60 via discharge valve 62 and is received in discharge cavity 64 formed in cylinder head 24. From cavity 64, discharge gas passes through discharge aperture 142 formed in valve plate 48, through discharge gas passage 144 formed in crankcase 22, and into discharge plenum 140.

The spinning rotation of rotor 30 causes a vortex tube or Coanda effect to occur in discharge plenum 140. The vortex tube effect, also known as the Ranque Vortex Tube effect, the Hilsch Tube effect, the Ranque-Hilsch Tube effect, and Maxwell's Demon, transforms a single or combined fluid flow into two fluid flows, consisting of a warmer fluid flow path and a cooler fluid flow path. The vortex tube effect is accomplished by imparting a spinning motion on a fluid flow source, whereby an outer flow path is formed which flows in one direction and an inner flow path is formed which flows in an opposite direction. This effect is characterized in that the inner flow path gives off kinetic energy in the form of heat to the outer flow path, whereby an output of cooler fluid flow occurs at one end of the vortex tube and warmer fluid is output at an opposite end of the vortex tube.

Figure 5:
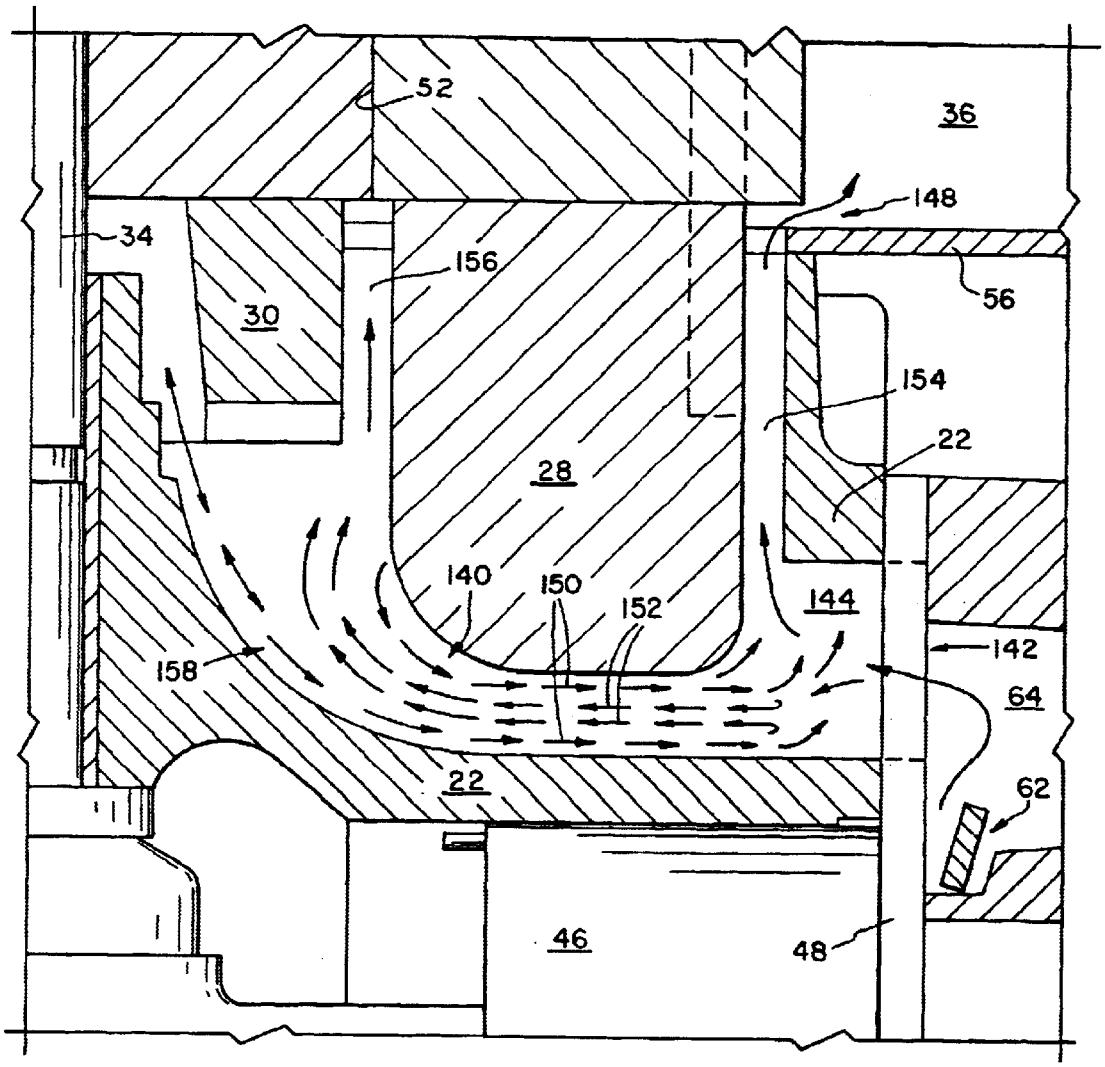
FIG. 5 is a cutaway sectional view of the motor and crankcase of the present invention illustrating the discharge gas flow paths invention illustrating the discharge gas flow paths associated with the vortex tube effect.

The compressor of the present invention, as illustrated in FIG. 5, utilizes the vortex tube effect as follows. Discharge gas at approximately 250–300 psi pressure enters discharge plenum 140 via discharge gas passage 144 and passes around the inner surfaces of discharge plenum 140 and external surface of the motor stator 28. The spinning action of rotor 30 accelerates the movement of the discharge gas in discharge gas plenum 140 and imparts a spinning vortex flow pattern 158 on such discharge gas flow. First circumferential gap 52 is provided between rotor 30 and stator 28 and is preferably approximately 0.030" wide. Second gap 148 is circumferentially located between stator 28 and separating plate 56 and is preferably approximately 0.050" wide. The spinning discharge gas vortex moves in a direction away from crankshaft 34 and toward housing 12. A definable portion of discharge gas is propelled through path 154 and exits through second gap 148 into discharge chamber 36.

The remaining discharge gas is forced back through a central part 152 of spinning vortex 158, so as to flow in a direction opposite outer flow path 150 of spinning vortex 158. Inner flow path 152 moves in a direction away from housing 12 and toward crankshaft 34. Spinning vortex 158 effectively cools the discharge gas flowing through inner flow path 152. This cooler fluid flows through cooler fluid flow path 156, between stator 28 and rotor 30, through gap 52, and into discharge chamber 36. Warmer discharge gas from outer flow stream 150 travels through hot gas flow path 154, formed between crankcase 22 and stator 28, through gap 148, and into discharge chamber 36. In this manner, motor 20 is effectively cooled by the cooler discharge gas flow, thereby enhancing motor operating efficiency and overall compressor operating efficiency.

Figure 6:
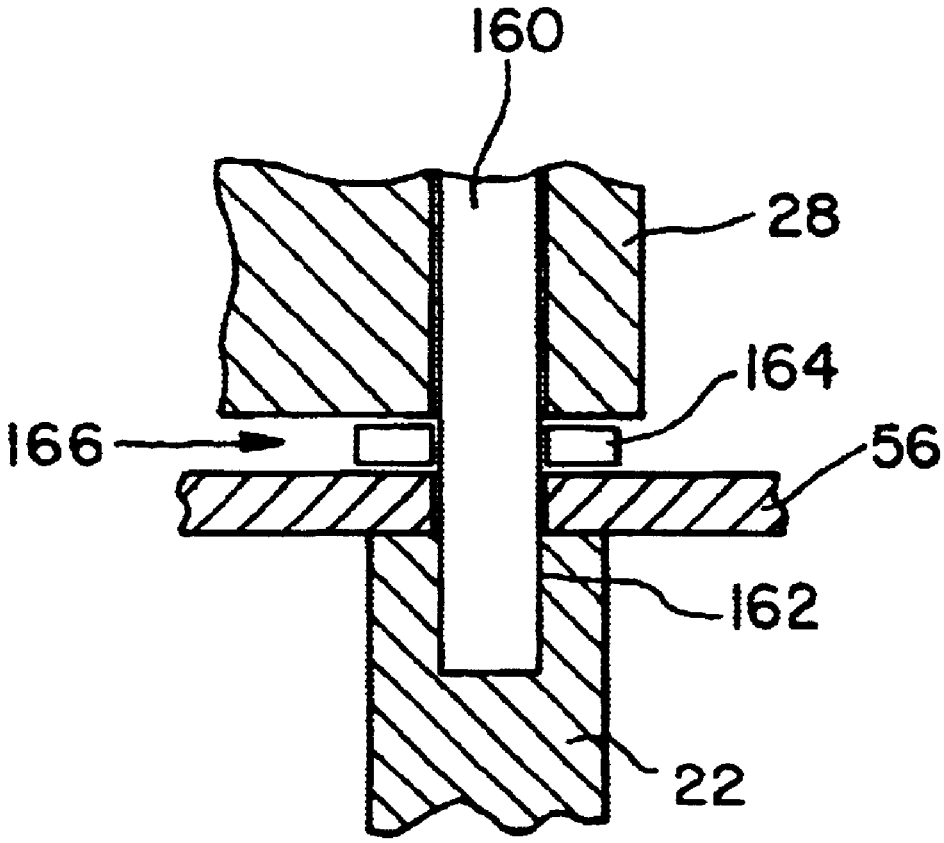
FIG. 6 is a cutaway sectional view of the interface between the stator and crankcase of the present invention, illustrating the stator/crankcase gap.

Stator 28 is affixed to crankcase 22 by a plurality of bolts 160, as shown in FIG. 6. The laminations which make up stator 28 are provided with bolt apertures which, with the laminations stacked and aligned one on top of the other, form a bolt receiving bore through stator 28. Separating plate 56 is disposed intermediate stator 28 and crankcase 22 and is provided with a bolt receiving hole. Crankcase 22 is provided with a threaded receiving bore 162. In accordance with the present invention, at least one spacer or washer 164 per bolt is disposed intermediate stator 28 and separating plate 56, or crankcase 22 in the absence of separating plate 56. Spacing washer 164 spacially separates stator 28 from separating plate 56, thereby establishing intermediate space 166 and gap 148.

The dimensions of gap 148 may be altered by placing multiple or various width washers 164 intermediate stator 28 and separating plate 56. The width of circumferential gap 148 determines the temperature and flow rate of the discharge gas flowing through cooler gas flow path 156 and through rotor/stator gap 52. Enlarging gap 148 reduces the temperature and flow rate associated with the discharge gas flowing through cooler gas flow path 156 and gap 52. Reducing gap 148 increases the temperature and flow rate of the discharge gas flowing through cooler gas flow path 156 and gap 52. In the preferred embodiment, gap 148 is sized to obtain maximum cooling efficiency, which is reached when approximately 80% of the discharge gas is directed toward and passes through rotor/stator gap 52.

In this manner, the compressor of the present invention utilizes the vortex tube effect to effectively cool the motor windings and accelerate the evacuation of discharge gas from discharge plenum 140 of crankcase 22, resulting in enhanced operating efficiency. Further, due to the high velocity and increased volume of discharge gas flowing through rotor/stator annular gap 52, rotor 30 is effectively lifted so as to reduced the load on the lower part of the main bearing.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A hermetic refrigerant compressor, comprising:

a hermetically sealed housing having a wall, said wall having a suction opening;

a compressor mechanism disposed in said housing, said compressor mechanism having a gas compression chamber therein and a discharge passage in communication with a discharge plenum; and a motor comprising a stator, a rotor attached to a crankshaft drivingly linked to said compressor mechanism, said rotor surrounded by said stator, a first gap formed between said rotor and said stator, and a second gap formed between said stator and said compressor mechanism, said discharge plenum in communication with said first and second gaps wherein during compressor operation discharge gas expelled from said gas compression chamber travels through said discharge passage, enters said discharge plenum from said discharge passage, and then substantially all of the refrigerant gas exiting said discharge plenum enters one of said first and second gaps from said discharge plenum, a spinning vortex of refrigerant gas being generated in said discharge plenum responsive to the spinning of said rotor and which has an outer flow path of warmer gas which travels through said second gap and an inner flow path of cooler gas which travels through said first gap, whereby motor cooling is improved.

2. The compressor of claim 1 wherein said compressor mechanism comprises a crankcase and cylinder head combination having a valve plate, said valve plate having a discharge valve opening, said discharge valve opening providing communication between said gas compression chamber and said discharge passage.

3. The compressor of claim 2 further comprising a separating plate interposed between said stator and said crankcase and cylinder head combination, wherein said second gap is formed between said stator and said separating plate.

4. The compressor of claim 1, wherein during compressor operation the inner and outer vortex flow paths travel in opposite directions, kinetic energy in the form of heat being transferred from the discharge gas in the inner flow path to the discharge gas in the outer flow path, whereby discharge gas having a reduced temperature is directed through said first gap to cool said motor and discharge gas having an elevated temperature is directed through said second gap, the flow of discharge gas through said discharge plenum and said motor being accelerated whereby compressor operating efficiency is improved.

5. A hermetic refrigerant compressor, comprising:

a hermetically sealed housing having a wall, said wall having a suction opening;

a compressor mechanism disposed in said housing, said compressor mechanism having a gas compression chamber therein and a discharge passage in communication with a discharge plenum; and a motor comprising a stator, a rotor attached to a crankshaft drivingly linked to said compressor mechanism, said rotor surrounded by said stator, a first gap formed between said rotor and said stator, and a second gap formed between said stator and said compressor mechanism, wherein during compressor operation discharge gas expelled from said gas compression chamber travels through said discharge passage, through said discharge plenum, and then through said first and second gaps, a spinning vortex of refrigerant gas being generated in said discharge plenum responsive to the spinning of said rotor and which has an outer flow path of warmer gas which travels through said second gap and an inner flow path of cooler gas which travels through said first gap, whereby motor cooling is improved; and wherein the temperature and the flow rate of the discharge gas through said first gap is dependent upon the size of said second gap.

6. The compressor of claim 5, wherein the temperature and flow rate of discharge gas flowing through said first gap is reduced by providing a relatively large said second gap and is increased by providing a relatively all said second gap.

7. The compressor of claim 5, wherein said second gap is adapted so that about 80% of the discharge gas in said discharge plenum passes through said first gap.

8. A hermetic refrigerant compressor, comprising:

a hermetically sealed housing having a wall, said wall having a suction opening;

a compressor mechanism disposed in said housing, said compressor mechanism having a gas compression chamber therein and a discharge passage in communication with a discharge plenum, said compressor mechanism comprising a crankcase and cylinder head combination having a valve plate, said valve plate having a discharge valve opening, said discharge valve opening providing communication between said gas compression chamber and said discharge passage; and a motor comprising a stator, a rotor attached to a crankshaft drivingly linked to said compressor mechanism, said rotor surrounded by said stator, a first gap formed between said rotor and said stator, and a second gap formed between said stator and said compressor mechanism, wherein during compressor operation discharge gas expelled from said gas compression chamber travels through said discharge passage, through said discharge plenum, and then through said first and second gaps, a spinning vortex of refrigerant gas being generated in said discharge plenum responsive to the spinning of said rotor and which has an outer flow path of warmer gas which travels through said second gap and an inner flow path of cooler gas which travels through said first gap, whereby motor cooling is improved; and wherein said second gap is formed by interposing at least one washer between said stator and said crankcase and cylinder head combination.

9. A hermetic refrigerant compressor, comprising:

a hermetically sealed housing having a wall, said wall having a suction opening;

a compressor mechanism disposed in said housing, said compressor mechanism having a gas compression chamber therein and a discharge passage in communication with a discharge plenum, said compressor mechanism comprising a crankcase and cylinder head combination having a valve plate, said valve plate having a discharge valve opening, said discharge valve opening providing communication between said gas compression chamber and said discharge passage;

a motor comprising a stator, a rotor attached to a crankshaft drivingly linked to said compressor mechanism, said rotor surrounded by said stator, a first gap formed between said rotor and said stator, and a second gap formed between said stator and said compressor mechanism, wherein during compressor operation discharge gas expelled from said gas compression chamber travels through said discharge passage, through said discharge plenum, and then through said first and second gaps, a spinning vortex of refrigerant gas being generated in said discharge plenum responsive to the spinning of said rotor and which has an outer flow path of warmer gas which travels through said second gap and an inner flow path of cooler gas which travels through said first gap, whereby motor cooling is improved; and a separating plate interposed between said stator and said crankcase and cylinder head combination, wherein said second gap is formed between said stator and said separating plate; and wherein said second gap is formed by interposing at least one washer between said stator and said separating plate.

10. A hermetic refrigerant compressor, comprising:

a hermetically sealed housing having a wall, said wall having a suction opening;

a compressor mechanism disposed in said housing and having a gas compression chamber therein and a discharge passage in communication with a discharge plenum; and a motor comprising a stator, a rotor attached to a crankshaft drivingly linked to said compressor mechanism, said rotor surrounded by said stator, a first gap formed between said rotor and said stator, and a second gap formed between said stator and said compressor mechanism, said discharge plenum in communication with said first and second gaps wherein during compressor operation discharge gas is expelled from said gas compression chamber and travels through said discharge passage, enters said discharge plenum from said discharge passage, and then substantially all of the refrigerant gas exiting said discharge plenum enters one of said first and second gaps from said discharge plenum, a first flow path of warmer gas which travels through said second gap and a second flow path of cooler gas which travels through said first gap being formed in response to the spinning of said rotor, whereby cooling of said motor is improved.

11. A method of cooling the motor in a hermetic refrigerant compressor including a compressor mechanism having a gas compression chamber therein, and a motor having a stator and a rotor, the method comprising the steps of:

communicating gas discharged from the gas compression chamber during compressor operation into a discharge gas plenum provided between the compressor mechanism and the motor;

creating a spinning vortex of discharge gas within the discharge plenum, whereby an inner flow path of cooler gas and an outer flow path of warmer gas are formed; and providing a first gap between the stator and rotor and a second gap between the stator and compressor mechanism and causing the cooler gas in said inner flow path to flow through said first gap and the warmer gas in said outer flow path to flow through said second gap.

* * * * *